US005757337A

United States Patent [19]

Hsueh et al.

[11] Patent Number: 5,757,337

[45] Date of Patent: May 26, 1998

[54] TELESCOPIC FLEXIBLE ANTENNA

[76] Inventors: Chih Yuan Hsueh; Der Shine Chia, both of No. 40, Fu Lin Street, Taoyuan City, Taiwan

[21] Appl. No.: 688,963

[22] Filed: Jul. 31, 1996

[51] Int. Cl.[6] ..... H01Q 1/10

[52] U.S. Cl. ..... 343/901; 343/889

[58] Field of Search ..... 343/702, 715, 343/900, 901, 903, 889; H01Q 1/10

[56] References Cited

U.S. PATENT DOCUMENTS 5,534,878 7/1996 Johnson ..... 343/901

5,594,459 1/1997 Hirota ..... 343/901

FOREIGN PATENT DOCUMENTS 52-60551 5/1977 Japan ..... 343/901

*Primary Examiner*—Michael C. Wimer

*Attorney, Agent, or Firm*—Morton J. Rosenberg; David I. Klein; Jun Y. Lee

[57] ABSTRACT

The invention is related to a telescopic and flexible antenna, comprising a plurality of main bodies each being a hollow tube to the lower end of which a conductor plug is affixed, with two arched conductor plates embracing the peripheral surface thereof to form a telescopic antenna, and characterized in that each main body encloses a resilient metal plate with conductor rings at its ends and abutting against the arched conductor plates of another main body.

1 Claim, 6 Drawing Sheets

TELESCOPIC FLEXIBLE ANTENNA

BACKGROUND OF THE INVENTION

The present invention relates to a telescopic antenna, especially to an antenna structure that is telescopic and elastically deflectable.

Because of the advancement of industrial technologies, electronic products have become an indispensable part of our lives. However, many communication apparatuses, such as radios, cellular telephones, and car wireless communication systems and so on, need antennas to receive or emit signals. These antennas are generally divided into two types, telescopic and flexible. The telescopic antenna has the advantages of space saving and enhanced ability of receiving signals. However, such an antenna could be vulnerable as it extends to the full length, resulting in poor signal receiving or even being broken. The flexible antenna does not have the above deficiencies but it often takes excessive space and lacks of an esthetic outer appearance. Accordingly, the object of the invention is to provide a telescopic and flexible antenna that has the following advantages:

1. The main body constituted by hollow tubes encloses a spring winding around and abutting against arched conductor plates of another main body so that an antenna consisting of such main bodies has extractible and elastically flexible features.

2. The spring is housed inside the antenna so that it is invisible from the outside, as a consequence of which the antenna according to the invention can give a nice-looking outer appearance.

3. The antenna according to the invention is easy in manufacturing and suitable for mass production.

4. The antenna according to the invention has a complete and reasonable structure that is easily put into practice.

Further objects, features, and advantages of the invention will be apparent from the following detailed description when taken in conjunction with the accompanying drawings.

BRIEF DESCRIPTION OF THE ACCOMPANYING DRAWINGS

DETAILED DESCRIPTION OF PREFERRED EMBODIMENTS

Figure 1:
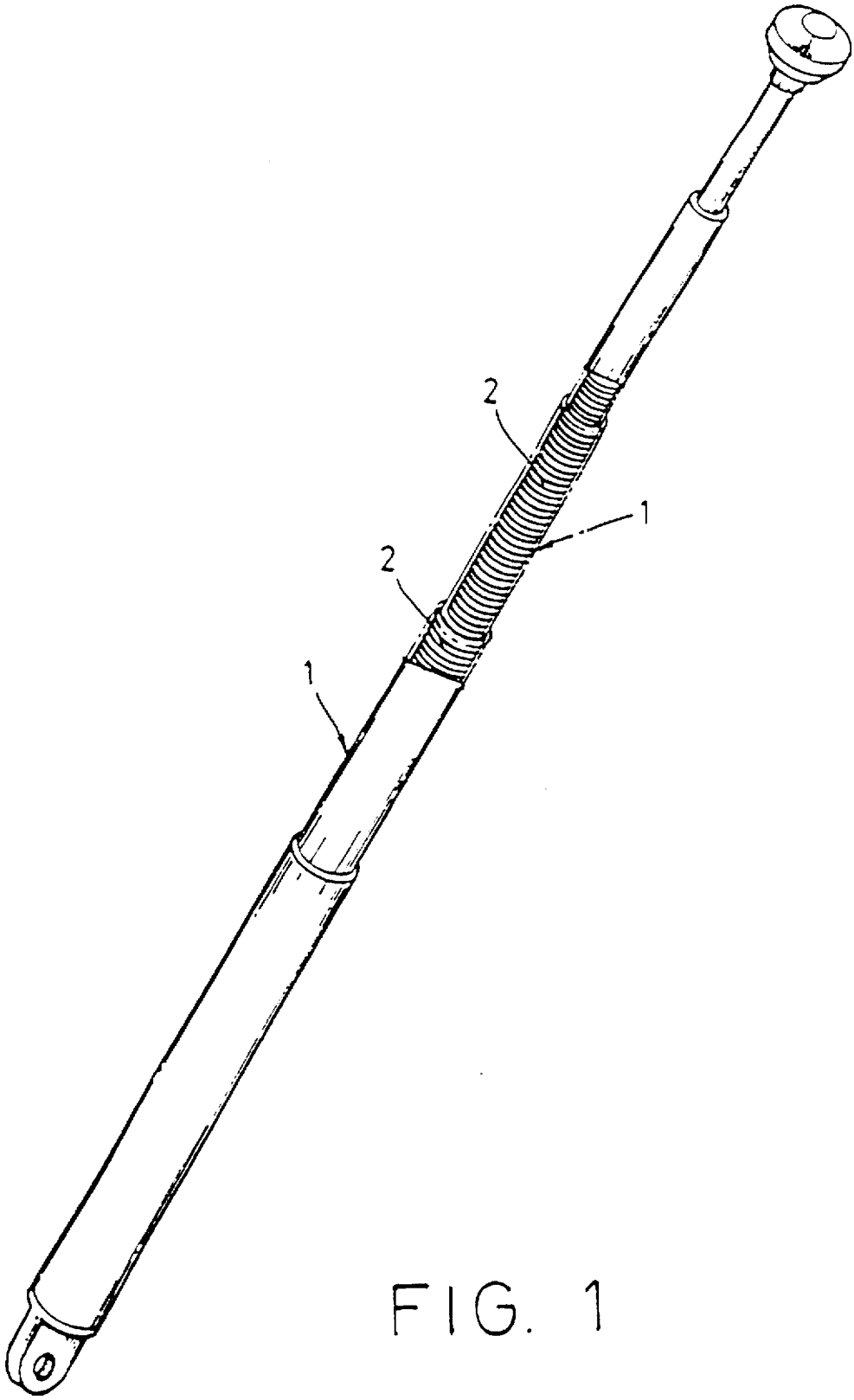
FIG. 1 is a perspective view showing an antenna according to the invention.
Figure 2:
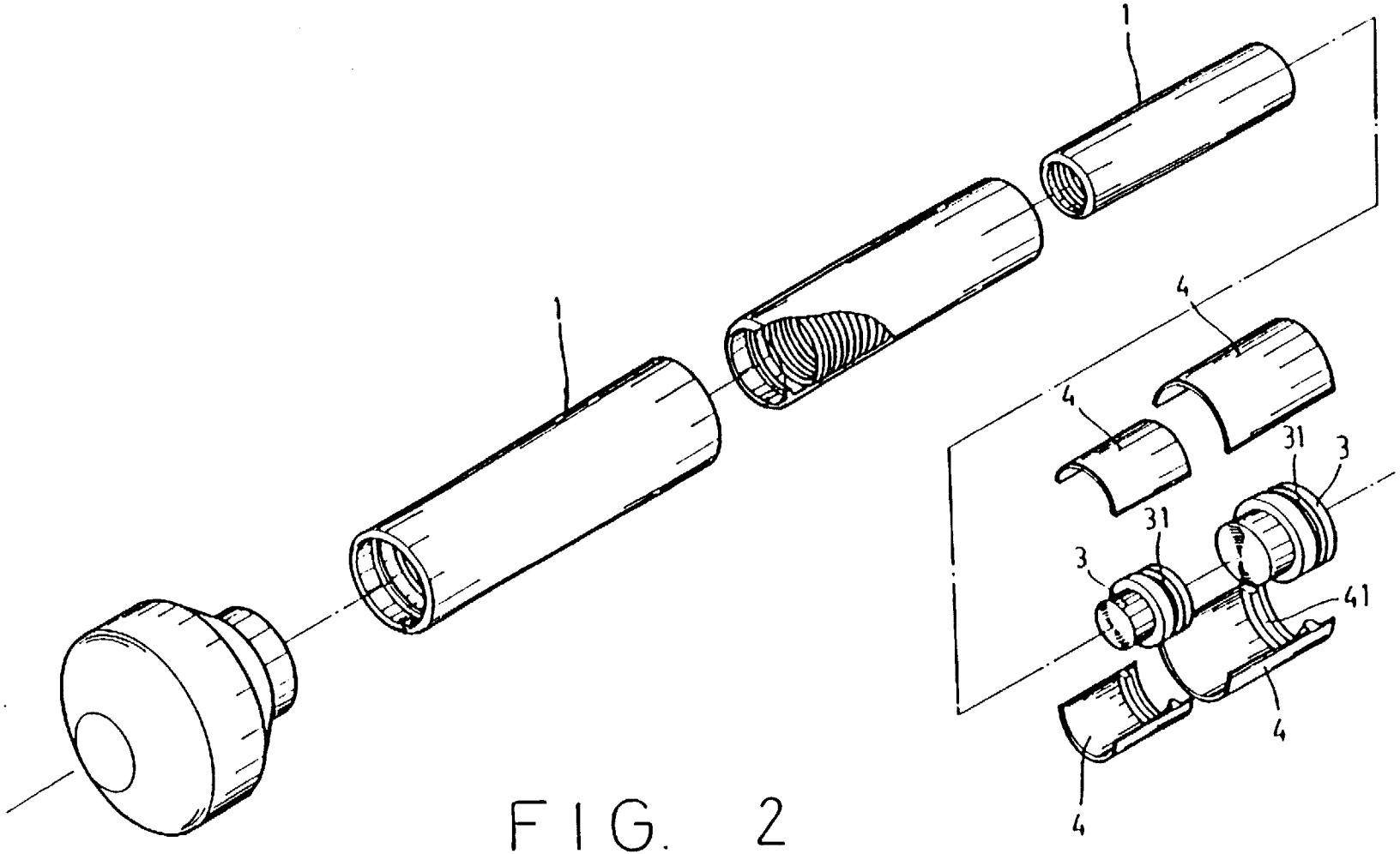
FIG. 2 is an exploded view showing the antenna of FIG. 1.

Referring to FIGS. 1 and 2, the antenna according to the invention mainly consists of a plurality of main bodies 1, to each of which a spring 2 is attached in such a winding manner that the antenna can acquire extractable and elastically flexible characteristics.

Figure 3:
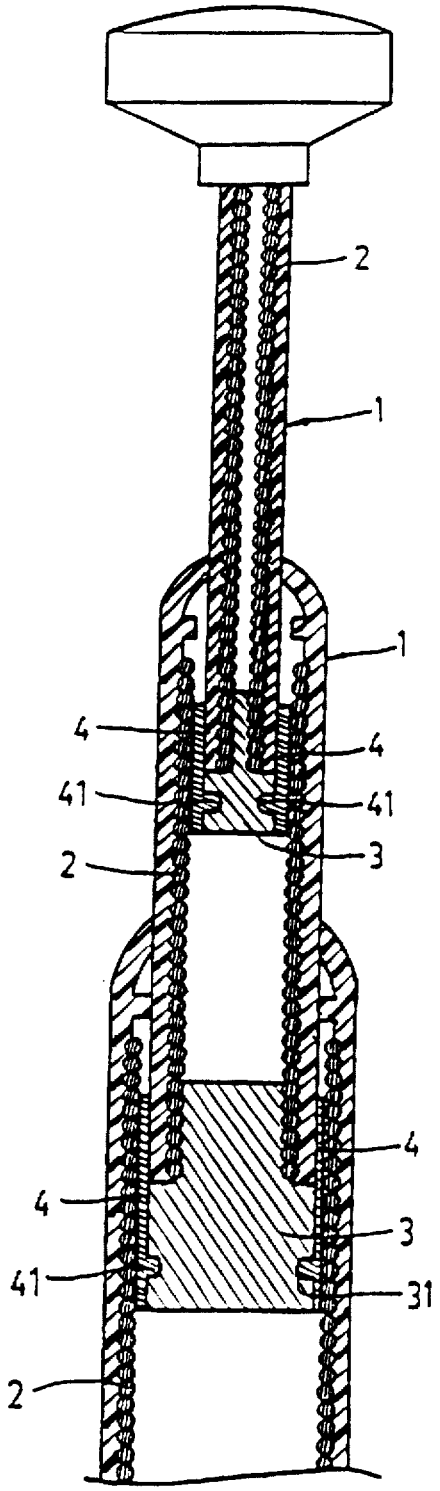
FIG. 3 is a cross-sectional view showing the antenna of FIG. 1.

As shown in FIGS. 2 and 3, the main body 1 is a plastic hollow tube, to the lower end of which is affixed a conductor plug 3 having a protrusion at the central portion. The conductor plug 3 comprises an annular groove 31 at the lower end and is embraced by two opposed arched conductor plates 4 each having a semi-circular ring 41 at a position corresponding to the annular groove 31 position so that the antenna can be extracted outwardly until an engagement of the semi-circular ring 41 with the annular groove 31. The construction is known in the prior art and not included in the scope of the invention. Hence the detailed description will be omitted. The improvement according to the invention is characterized in that the main body 1 encloses a spring 2 abutting against arched conductor plates 4 of another main body 1.

The features of an antenna according to the invention will be described now.

Figure 4:
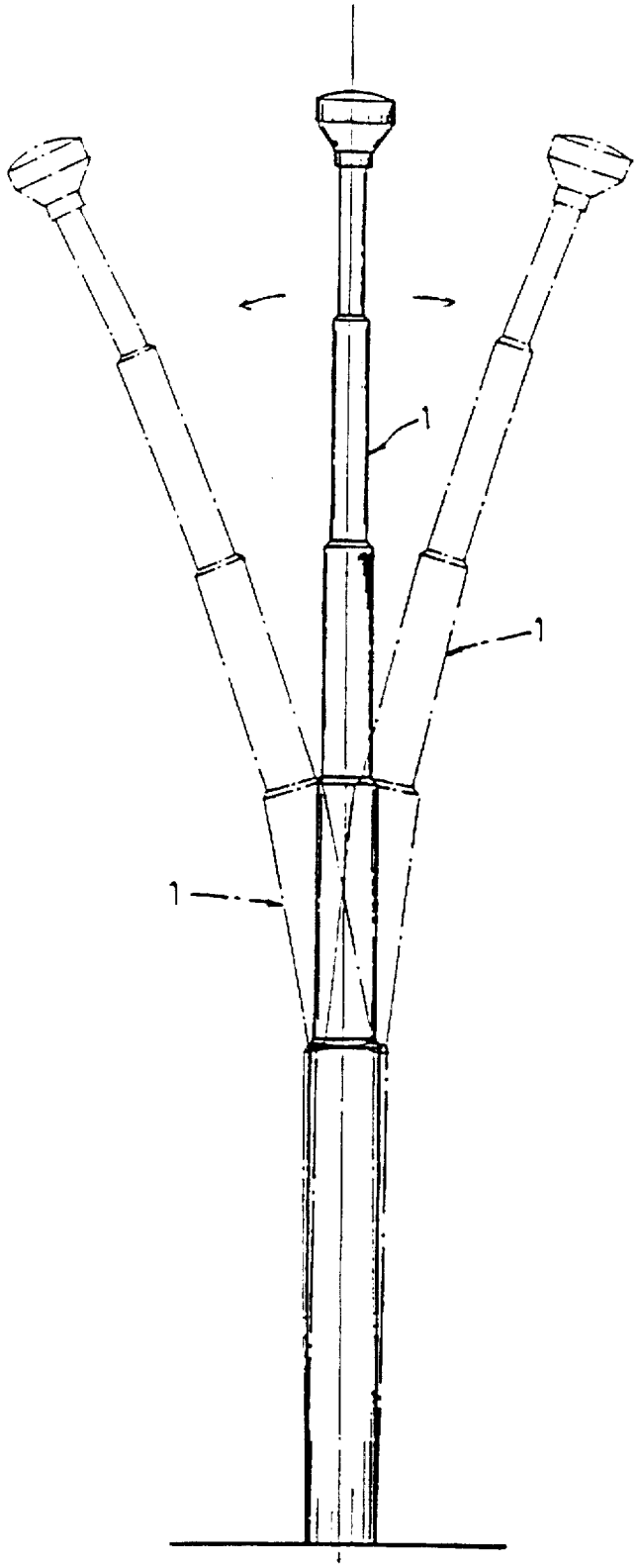
FIG. 4 is a plan view schematically showing the deflection of the antenna under the action of an external force.

Referring to FIG. 4, the antenna of the invention is constructed by plastic main bodies 1 each containing a spring 2 inside so that the antenna has flexibility. When the antenna is acted by an external force, it can elastically deflect in conformity with the direction of forces. Hence, the antenna can avoid being broken and achieves the maximum survival possibility.

Figure 5:
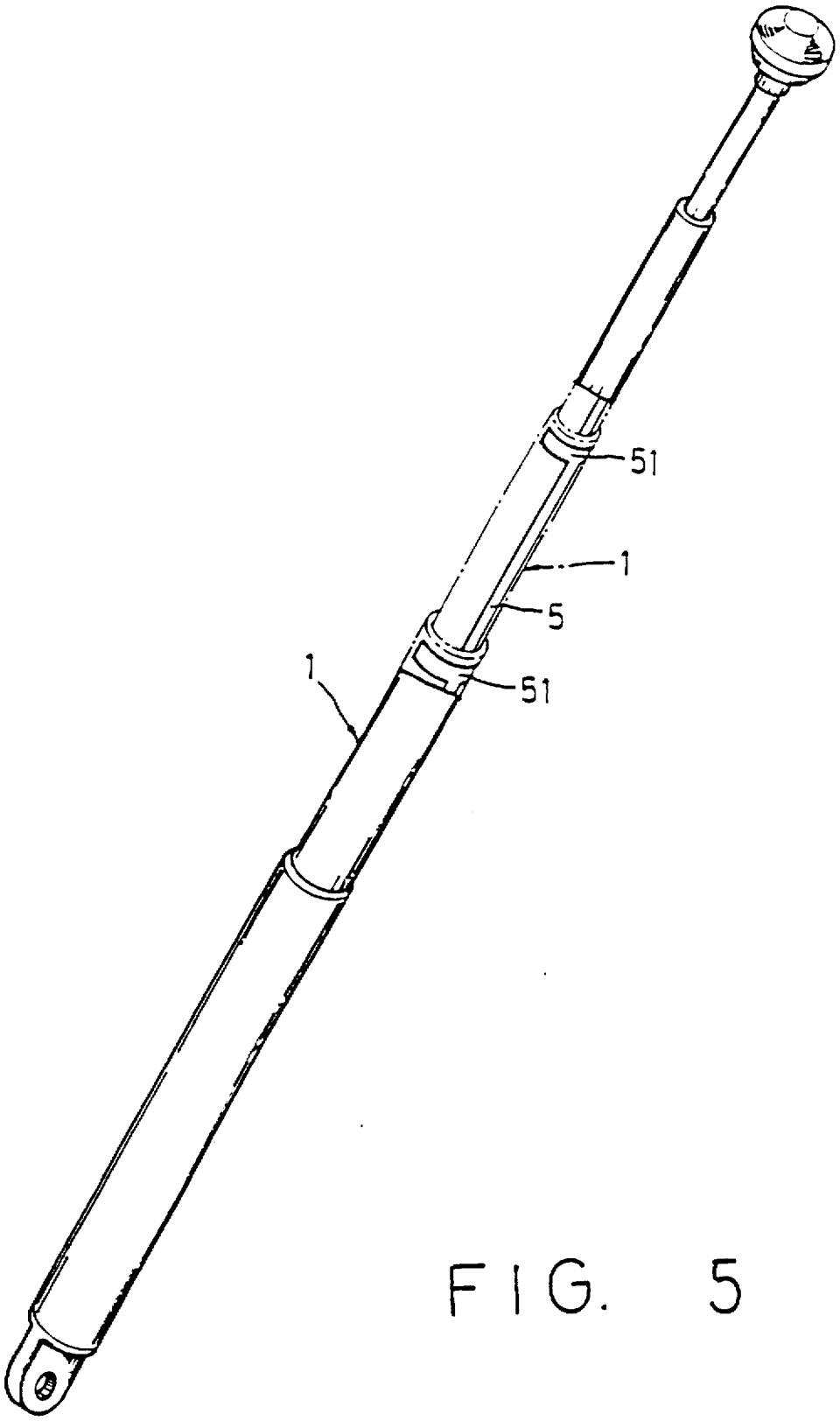
FIG. 5 shows another embodiment of an antenna according to the invention.
Figure 6:
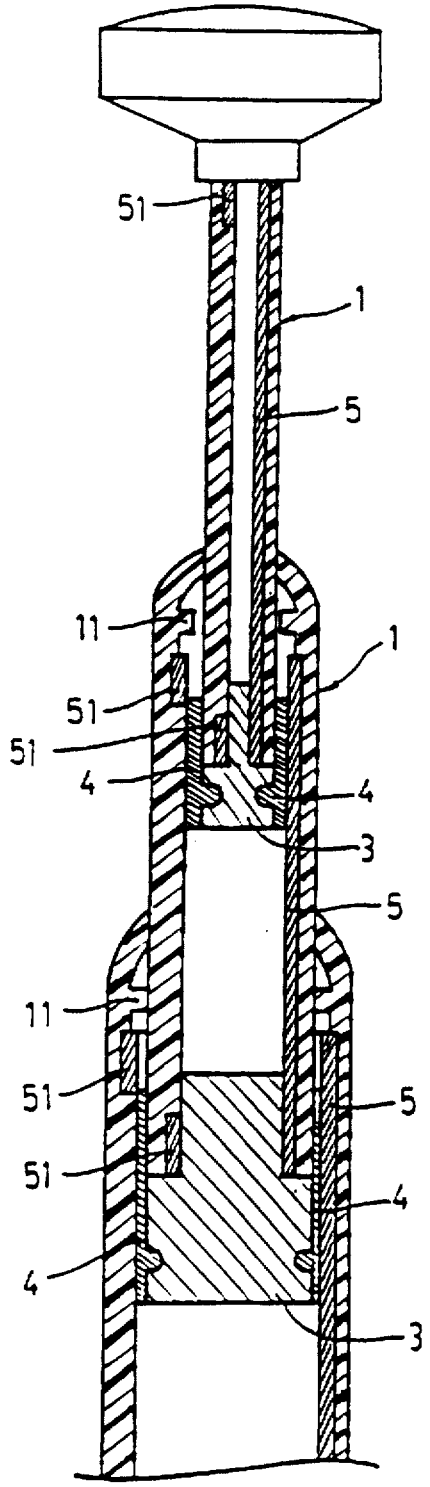
FIG. 6 is a cross-sectional view of the antenna of FIG. 5.

FIGS. 5 and 6 show another embodiment of the invention. In the figures the main body 1 further comprises a resilient metal plate 5 abutting against the arched conductor plate 4 and extending at its two ends to form a conductor ring 51 having an effect of enhancing the flexible strength of the main body 1.

From the above description, evidently the invention can obtain the advantages of space-saving and having flexibility by a combination of a spring 2 and arched conductor plates 4. Additionally it is superior in structure integrity and esthetic outer appearance. The invention can also adopt a design of the resilient metal plate 5 and the conductor ring 51. Therefore, the invention is unique and innovative.

What is claimed is:

1. A telescopic and flexible antenna, comprising a plurality of main bodies telescopically joined together, each of said plurality of main bodies being formed by (1) a longitudinally extended tubular member having a through bore and being formed of a plastic material composition, said tubular member having a longitudinally extended recess formed in open communication with said through bore, (2) a resilient conductive plate member disposed within said longitudinally extended recess, said conductive plate member having a pair of ring shaped portions respectively formed on opposing ends thereof, each of said ring shaped portions being disposed within a respective annular recess formed at opposing ends of said longitudinally extended recess, (3) a conductive plug member having a first end portion extending into said through bore and contacting a respective one of said pair of ring shaped portions of said conductive plate member and a second end portion extending from an end of said tubular member, and (4) a pair of arched conductive plates coupled to said second end portion of said plug member and extending circumferentially about a perimeter surface thereof, said second end portion of said plug member of a first of said plurality of main bodies extending into said through bore of a second of said plurality of main bodies and at least one of said pair of arched conductive plates of said first main body contacting said plate member of said second main body.

* * * * *